US005819503A

United States Patent [19]

Lancaster, III

[11] Patent Number: 5,819,503

[45] Date of Patent: Oct. 13, 1998

[54] METHOD AND APPARATUS FOR WRAPPING A LOAD INCLUDING A WATERPROOF TOP SHEET

[75] Inventor: Patrick R. Lancaster, III, Louisville, Ky.

[73] Assignee: Lantech, Inc., Louisville, Ky.

[21] Appl. No.: 873,181

[22] Filed: Jun. 11, 1997

[51] Int. Cl.[6] ..... B65B 13/04; B65B 41/02

[52] U.S. Cl. ..... 53/399; 53/449; 53/587; 53/176

[58] Field of Search ..... 53/399, 449, 176, 53/587, 588, 441, 556

[56] References Cited

U.S. PATENT DOCUMENTS 4,936,080 6/1990 Haloila ..... 53/588 X

FOREIGN PATENT DOCUMENTS 3344940 6/1985 Germany ..... 53/588

4016424 11/1991 Germany ..... 53/587

2192853 1/1988 United Kingdom ..... 53/587

OTHER PUBLICATIONS

Selling Guide for Lantech, Inc.'s Top Sheet Dispenser Film Hoist Option for Models TSDMH and TSDEH.

Informational Flyer on Lantech, Inc.'s Top Sheet Dispenser Option.

Informational Flyer on Lantech, Inc.'s Top Sheet Dispenser Film Hoist Option for Models TSDMH and TSDEH.

*Primary Examiner*—Linda Johnson

*Attorney, Agent, or Firm*—Finnegan, Henderson, Farabow, Garrett & Dunner, L.L.P.

[57] ABSTRACT

Loads are stretch wrapped by applying a waterproof top sheet to a load, lifting the edges of the waterproof top sheet while the sides of the load are wrapped with waterproof packaging material, releasing the edges of the waterproof top sheet and securing the edges of the waterproof top sheet around the load.

33 Claims, 6 Drawing Sheets

METHOD AND APPARATUS FOR WRAPPING A LOAD INCLUDING A WATERPROOF TOP SHEET

BACKGROUND OF THE INVENTION

The invention relates to wrapping methods and apparatus for wrapping the top and sides of a load with packaging material.

DESCRIPTION OF THE RELATED ART

Stretch wrapping can be performed as an inline automated packaging technique which dispenses and wraps packaging material in a stretched condition around a load on a pallet to cover and contain the load. Pallet stretch wrapping, whether accomplished by turntable, overhead arm, or rotating ring typically covers the four vertical sides of the load with a stretchable film such as polyethylene film. In some applications of pallet stretch wrapping, the top of the load is provided with additional protection known as a dust cover. Dust cover protection is accomplished by applying a top sheet of film to the load prior to wrapping the sides of the load with the stretch film. This method can be accomplished inline with the use of a top sheet dispenser by advancing the load and pallet as a sheet of film is dispensed from overhead. The load then advances into the wrapping position and the sides of the load are wrapped with the stretch film, producing the dust cover protection. Although the stretch film holds the top sheet in place, water can seep down between the top sheet and the stretch film onto the contents of the load. In an effort to make the packaging waterproof, various methods of applying the packaging have been used. Many of these methods require interruption of the wrapping operation or manual application of the top sheet. For example, loose bags have been manually placed over the loads and then overwrapped with stretch film which slows the wrapping process. Alternatively, during inline wrapping, a top sheet is applied after the sides of the load have been wrapped. The edges of the top sheet are then heat sealed to the edges of the stretch film. Heat sealing requires additional elements to be added to the system as well as adding time to the process. Another inline process stops the turntable (or its equivalent) so that a sheet of film may be placed on top of the load. The turntable begins again, and a second layer of wrapping is applied around the sides of the load, effectively trapping the top sheet between the two layers. Thus, any water which seeps down between the top sheet and the overwrapped film cannot reach the contents of the load. Although this process produces a waterproof load, the wrapping cycle must be interrupted for the application of the top sheet, reducing the throughput of the system by about 20–40%.

SUMMARY OF THE INVENTION

In light of the drawbacks of the packaging methods described, there is a need for a method and apparatus to provide a waterproof wrap to a load in a more time-efficient, cost-effective manner. Accordingly, the present invention is directed to an improved apparatus and method that obviates the limitations and disadvantages of conventional stretch wrapping apparatus.

Additional features and advantages of the present invention will be set forth in the description which follows, and in part will be apparent from the description, or may be learned by practice of the invention. The objectives and advantages of the invention will be realized and attained by means of the elements and combinations particularly pointed out in the appended claims.

To achieve these and other advantages and in accordance with the present invention, as embodied and broadly described herein, a method and apparatus is provided for wrapping a load.

According to one aspect of the invention, a method of wrapping a top and sides of a load is provided, the method including the steps of placing a waterproof top sheet having edges and a central area on top of a load at a location, transporting the load and top sheet to a wrapping area, lifting the edges of the waterproof top sheet away from the load, dispensing waterproof packaging material from a packaging material dispenser and providing relative rotation between the load and the packaging material dispenser to wrap waterproof packaging material around the sides of the load in the wrapping area, covering the sides of the load with the waterproof packaging material and positioning a portion of the waterproof packaging material beneath the edges of the waterproof top sheet while the edges of the waterproof top sheet are lifted, lowering the edges of the waterproof top sheet over the dispensed sheet of waterproof packaging material, and securing the edges of the waterproof top sheet over the dispensed sheet of waterproof packaging material.

According to another aspect of the invention, an apparatus for wrapping a top and sides of a load is provided, comprising a packaging material dispenser for dispensing waterproof packaging material in a wrapping area, means for providing relative rotation between the load and the packaging material dispenser in the wrapping area to wrap waterproof packaging material around the sides of the load in the wrapping area, means for lifting edges of a waterproof top sheet on the load in the wrapping area to permit waterproof packaging material to be wrapped around the sides of the load beneath the edges of the waterproof top sheet while the edges of the waterproof top sheet are lifted.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a pair of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
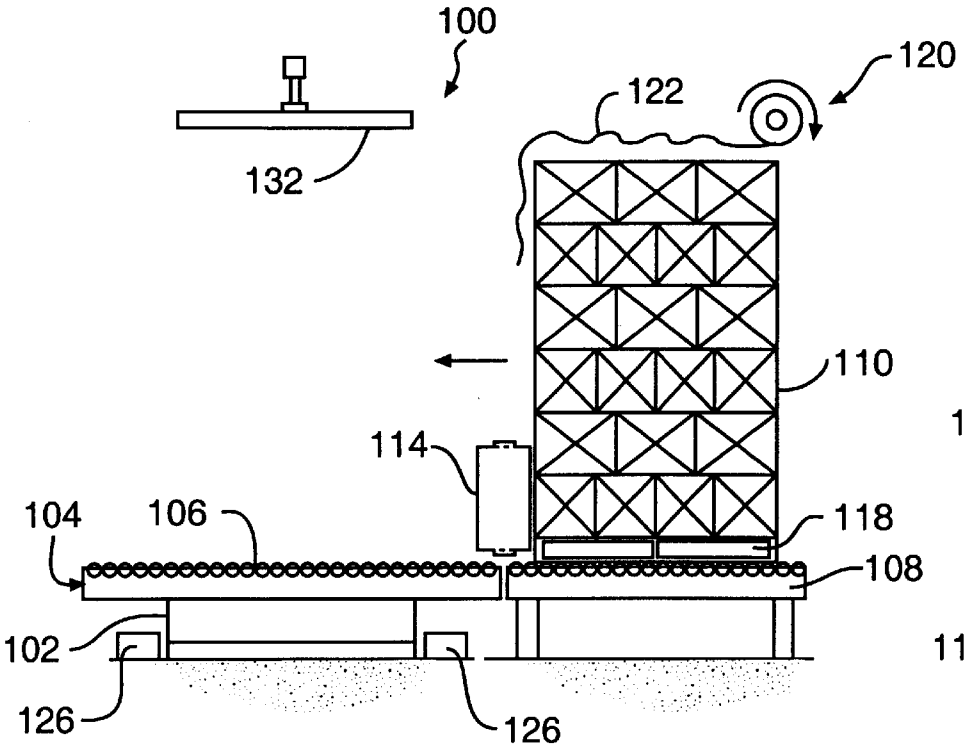
FIGS. 1–8 are side schematics of a load being stretch wrapped according to an embodiment of a method, and by an embodiment of an apparatus, according to the present invention.
Figure 2:
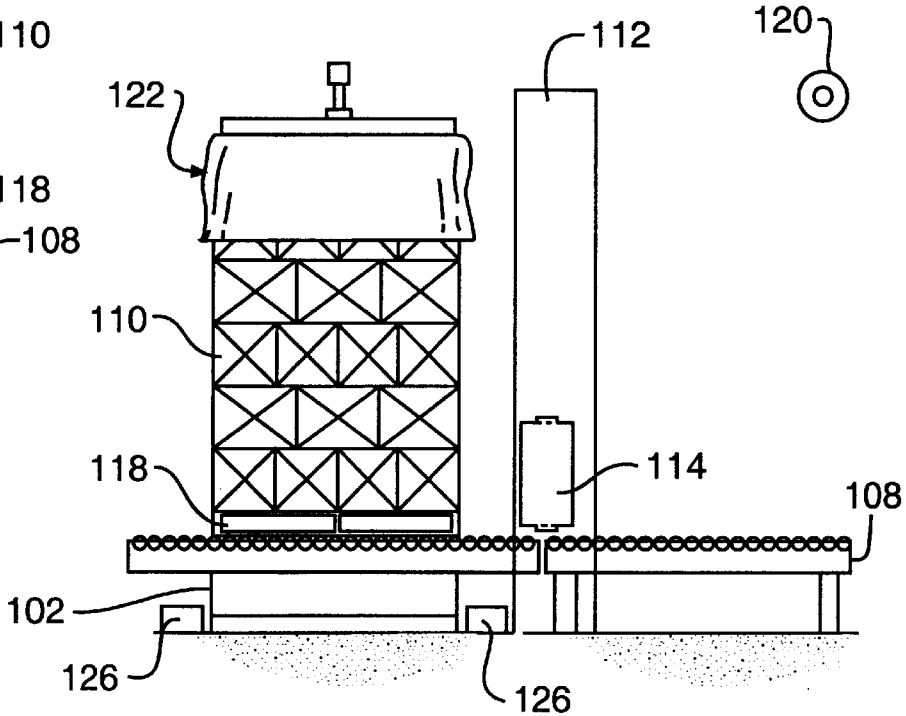

Reference will now be made in detail to the present preferred embodiments of the invention, examples of which are illustrated in the accompanying drawings. Wherever possible, the same reference numbers will be used throughout the drawings to refer to the same or like parts.

One aspect of the present invention relates to a method and apparatus for stretch wrapping loads that applies a waterproof top sheet to the load before wrapping commences. During the stretch wrapping, the portions of the waterproof top sheet extending over the sides of the load, hereinafter referred to as the edges of the waterproof top sheet, are displaced upwardly in order to allow application of waterproof wrapping material to the entire sides of the load for protection against moisture. After the sides of the load have been completely wrapped, the waterproof top sheet is released and its edges secured around the load as will be more fully described below.

Load wrapping can be a continuous process without delays or stops between an area in which the load is built and an area in which the load is wrapped. As the load is conveyed from a load building area to a load wrapping area, a waterproof top sheet is dispensed onto the top of the load, such that the load is ready to be wrapped when it reaches the wrapping area. This overcomes throughput reductions incurred by stopping the load to apply a waterproof top sheet. The wrapping process preferably includes structure to hold the center of the waterproof top sheet in place while its edges are displaced and the sides of the load are being wrapped.

The invention preferably employs a waterproof top sheet and waterproof packaging material that is wrapped around the sides of the load. Such waterproof materials are materials through which water is unlikely to pass in the normal exposure of a wrapped load to weather during temporary outside storage or transport. Such waterproof materials may include stretch wrap packaging material, other plastic materials, coated or treated paper or cloth, or other materials performing this function.

A description of the preferred embodiments of the apparatus for wrapping a load according to the present invention will now be described, to be followed by a description of the related methods of wrapping a load using these apparatuses.

FIGS. 1–8 show a first embodiment of a load wrapping apparatus 100 according to an aspect of the present invention. Apparatus 100 includes a conventional turntable 102 having an upper conveying surface 104 with a plurality of powered rollers 106. Apparatus 100 is controlled by a controller or microprocessor which can control the actuation of each of the elements comprising apparatus 100. Turntable 102 is positioned proximate a conveyor 108 for receiving a load 110 to be wrapped from a load building area. A mast 112, shown in FIG. 2, carries a stretch wrap packaging material dispenser 114 that dispenses waterproof stretch wrap material 116 around load 110 assembled on a pallet 118. Waterproof packaging material 116 alternatively may be any conventional packaging material or film. Load 110 is rotated by turntable 102 to provide relative motion between dispenser 114 and load 110. Relative rotation may also be accomplished by rotating a dispenser around a stationary load.

Located above conveyor 108 is a top sheet dispenser 120 for dispensing a waterproof top sheet 122 onto load 110 as it passes below top sheet dispenser 120 en route to the wrapping area. Waterproof top sheet 122 may be placed onto the load either manually or automatically. Waterproof top sheet 122 must be of such a size that it extends over the top layer of load 110, and may be either pre-cut or cut to size as load 110 passes underneath top sheet dispenser 120 on conveyor 108. Waterproof top sheet 122 may be any suitable packaging material or film, preferably a waterproof or water resistant material.

Figure 7:
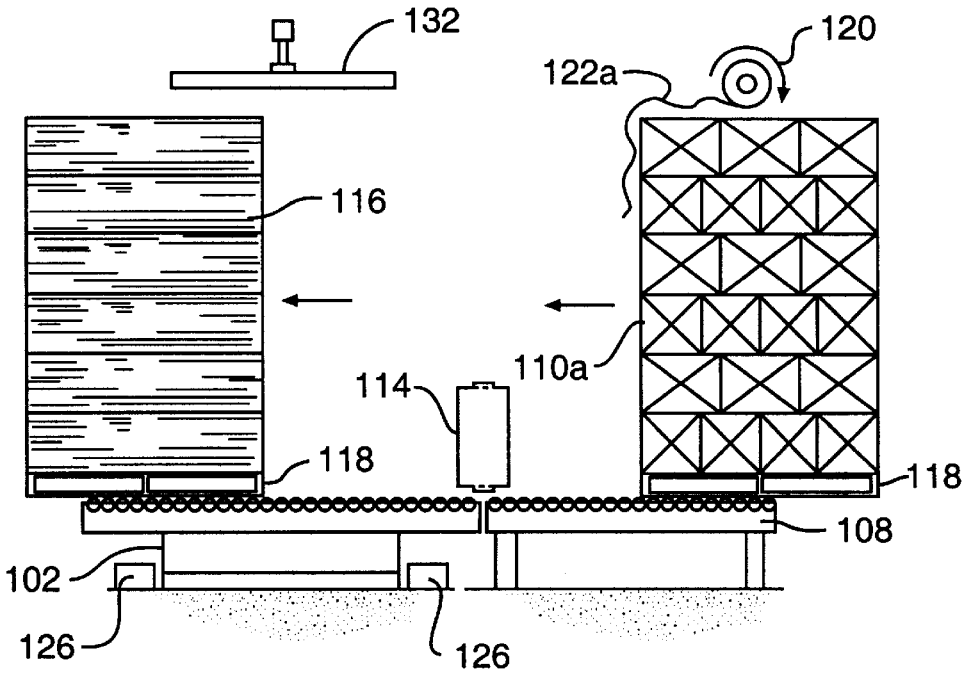
Figure 8:
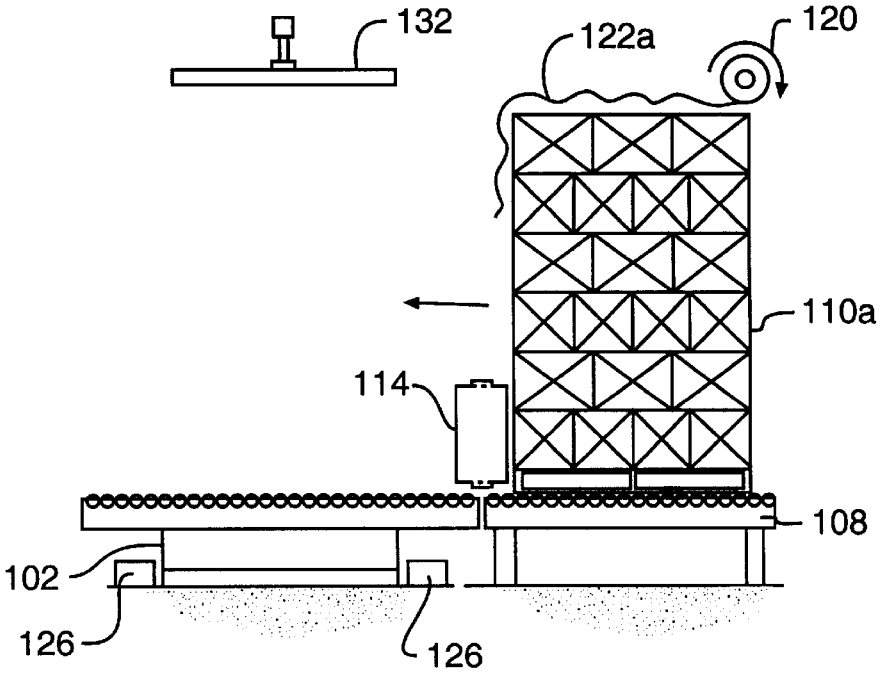
Figure 9:
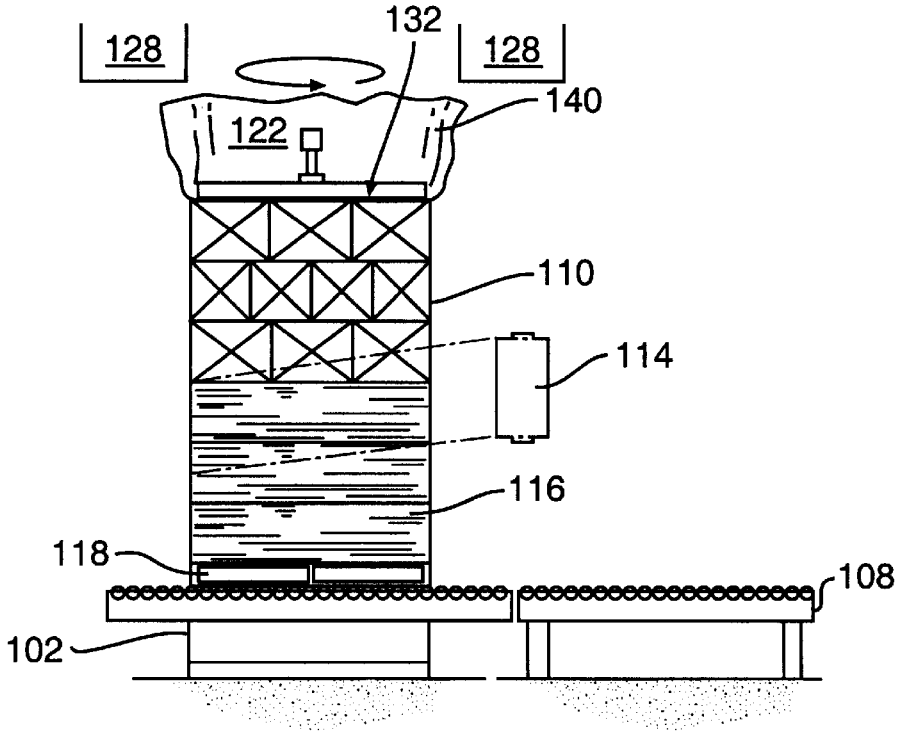
FIG. 9 is a side view of a second embodiment of a method and apparatus for stretch wrapping loads.
Figure 10:
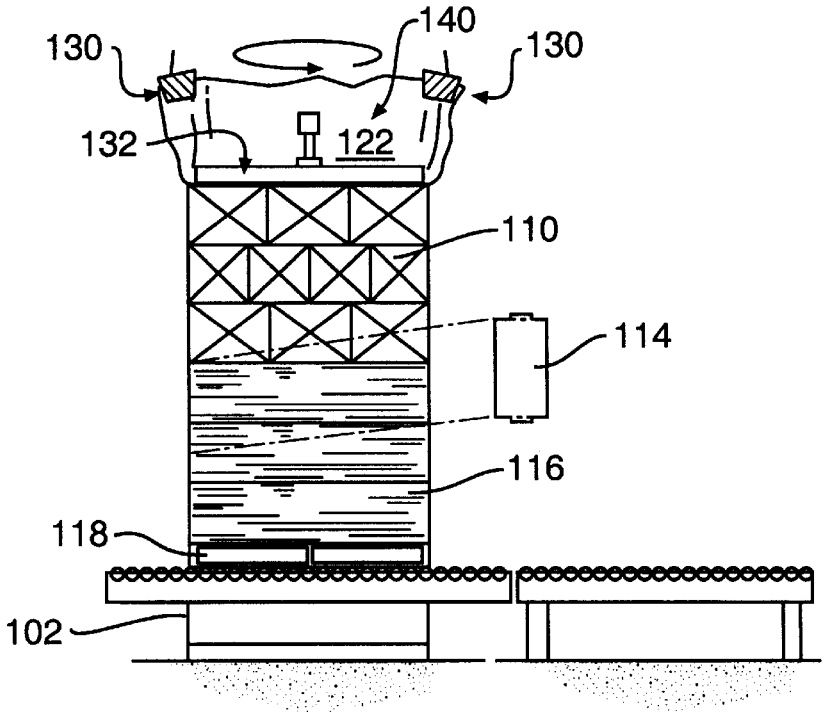
FIG. 10 is a side view of a third embodiment of a method and apparatus for stretch wrapping loads.
Figure 11:
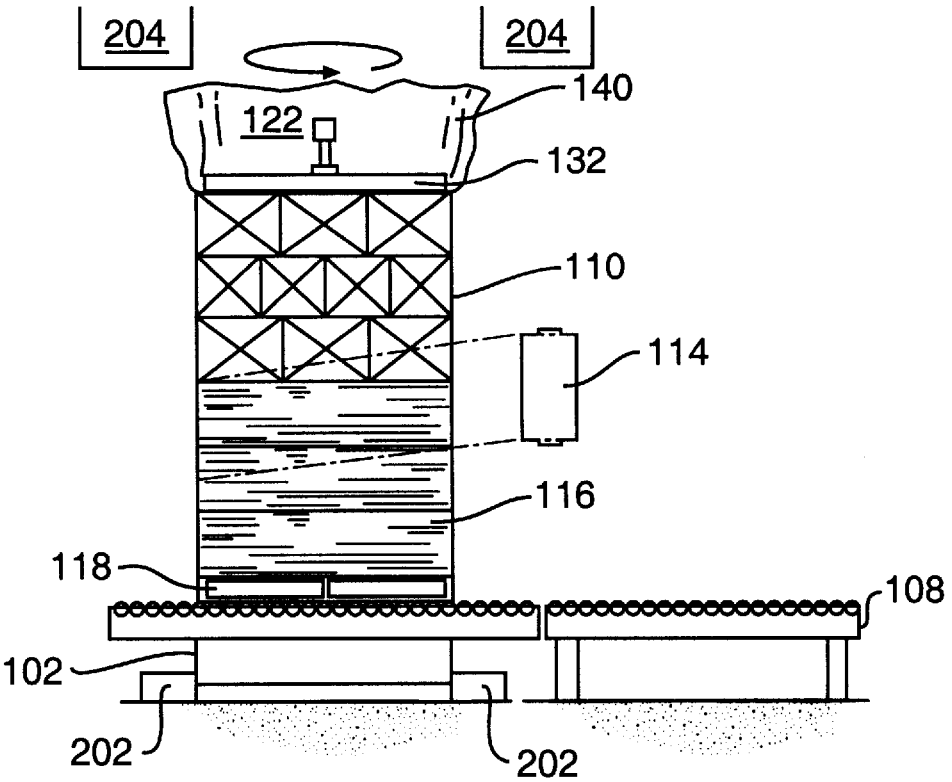
FIG. 11 is a side view of a fourth embodiment of a method and apparatus for stretch wrapping loads.

Structure for lifting edges 140 of waterproof top sheet 122 is provided in or proximate to turntable 102, for lifting edges 140 of waterproof top sheet 122 to a position such that edges 140 do not interfere with the wrapping of the sides of load 110. The structure for lifting waterproof top sheet edges 140 may include a structure for blowing edges 140 upwards, such as a fan 126, as seen in FIGS. 1–8, suction ducts 128, such as a vacuum or reverse fan, located above turntable 102 to pull edges 140 upward by suction, as seen in FIG. 9, or structure for grasping edges 140 of waterproof top sheet 122 and lifting edges 140, such as pinchers or clamps 130, as seen in FIG. 10. Alternatively, as shown in FIG. 11, two sets of fans 202, 204, may be provided. First set of fans 202 is located below load 110 and is provided to lift edges 140 of waterproof top sheet 122. Second set of fans 204 is located above load 110 and is provided to force edges 140 of waterproof top sheet 122 down over the sides of load 110 for securing. In the alternative, edges 140 may be lifted by a tacky surface, or a vacuum clamp, or manually.

Structure for holding a central portion of the waterproof top sheet 122 onto the top of load 110 may be used to hold waterproof top sheet 122 in place while edges 140 are lifted and the sides of the load are being wrapped. This may be accomplished by placing a platen 132 on the center of waterproof top sheet 122 before edges 140 of waterproof top sheet 122 are lifted. Other suitable devices for holding waterproof top sheet 122 in place include a mat, bean bag, or any other device that applies sufficient weight to waterproof top sheet 122.

Figure 3:
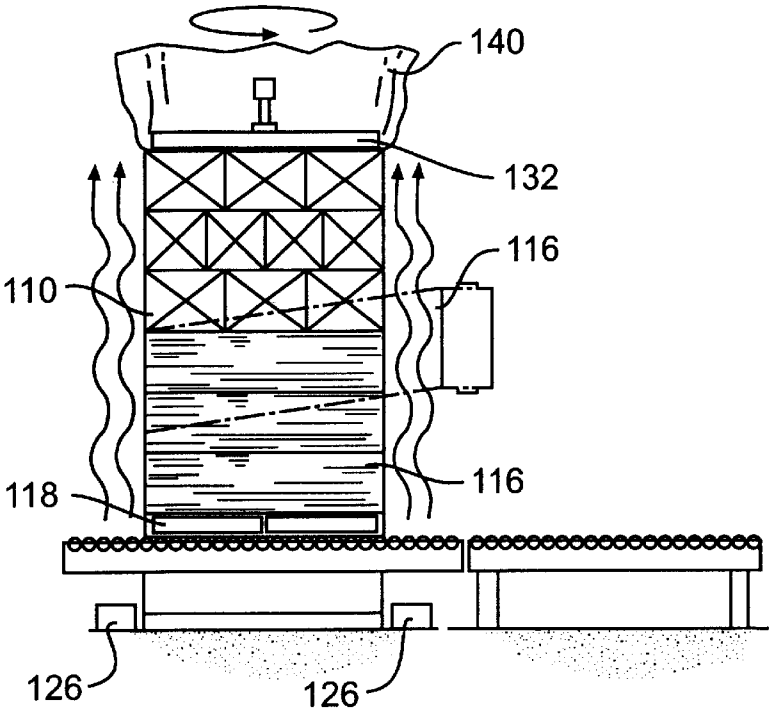

As seen in FIG. 3, relative rotation between load 110 and packaging material dispenser 114 is provided by turntable 102 which supports and rotates the load about a vertical axis. Alternative mechanisms for providing relative rotation between dispenser 114 and load 110 include an arm or ring which supports and revolves wrap dispenser 114 around a stationary load 110.

Figure 6:
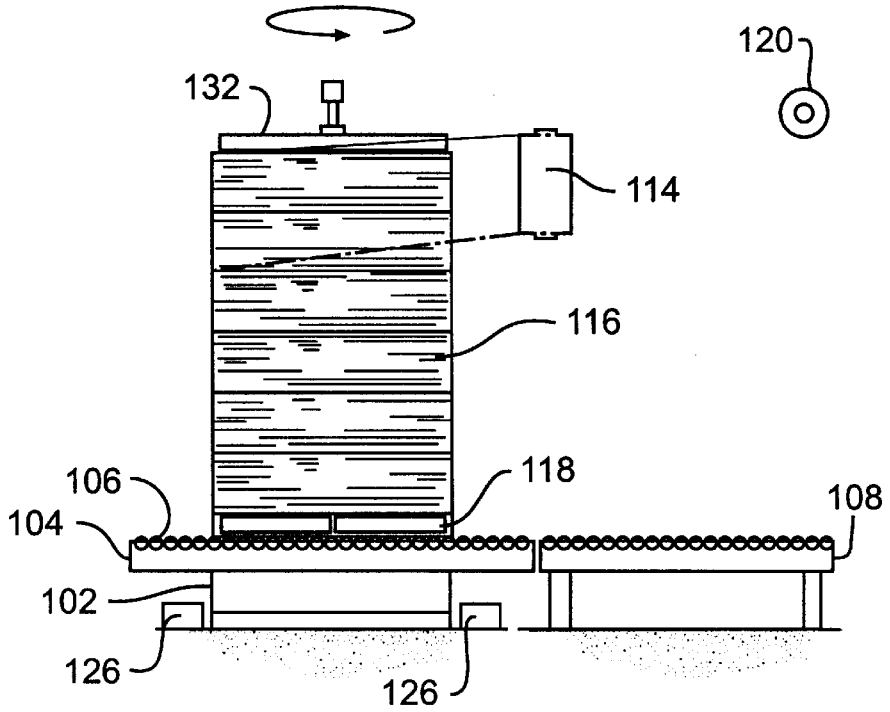

Additionally, structure is provided to secure edges 140 of waterproof top sheet 122 over the wrapped sides of load 110. Securing may be performed in an automated, controlled procedure or manually. Edges 140 may be secured by rope, bands of material such polymers or metals, an additional layer of waterproof packaging material, or an adhesive type material. For example, FIG. 6 shows edges 140 of waterproof top sheet 122 secured by a second layer of waterproof packaging material 116. When waterproof packaging material 116 is used, waterproof packaging material 116 is brought to the top of load 110 and preferably high enough in relation to the top of the load so as to overlap the top corners of load 110, fold over the corner, and thus conform to the load.

A description of a method of stretch wrapping a load according to the present invention, as shown in FIGS. 1–8, and using apparatus 100 shown in FIG. 1, will now be provided. The operation starts when the load is placed on a conveyer and a controller to control the conveyer is activated. Once the conveyer is moving, top sheet dispenser 120 dispenses a waterproof top sheet 122 which is placed onto the load 110 as it indexes into the wrapping area. Once in the wrapping area, load 110 is located such that it is positioned above the structure for lifting edges 140 of waterproof top sheet 122 and the controller activates the structure for lifting edges 140 of waterproof top sheet 122 away from load 110 to permit waterproof packaging material 116 to be wrapped around the sides of load 110 beneath edges 140 of waterproof top sheet 122.

In the embodiment shown in FIGS. 1–8, in order to lift edges 140 of waterproof top sheet 122, fan 126, located below load 110, is turned on forcing air between waterproof top sheet 122 and load 110, pushing edges 140 of waterproof top sheet 122 upwards. To release edges 140, fan 126 is shut off.

Figure 4:
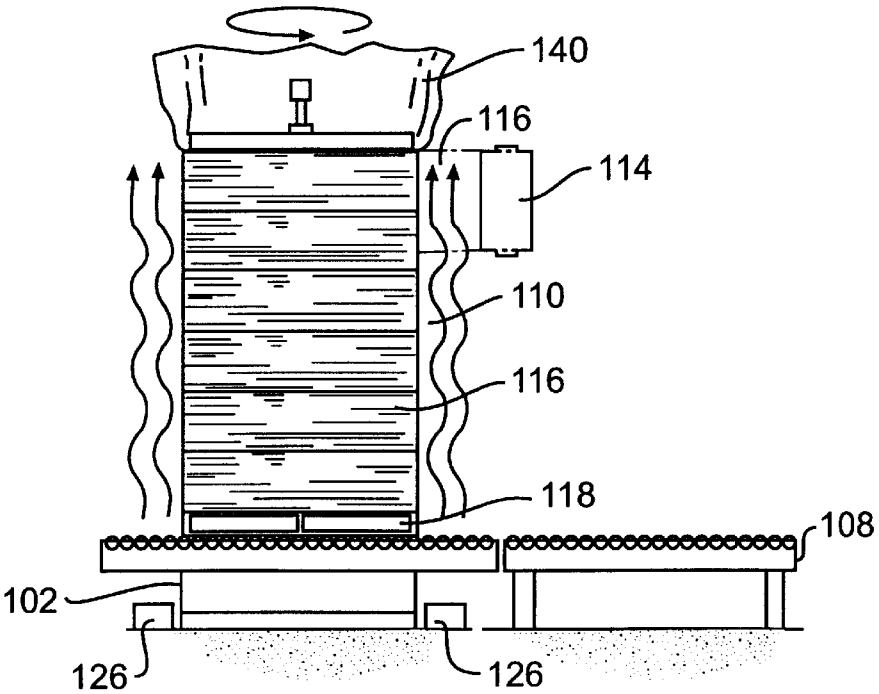

As shown in FIG. 3, once load 110 is in the wrapping area, edges 140 of waterproof top sheet 122 are lifted away from load 110 by fan 126, and relative motion is provided between the wrap dispenser 114, which moves up and down along mast 112, and load 110, to wrap waterproof packaging material 116 on load 110. In this step, as shown in FIG. 4, waterproof stretch packaging material 116 is brought to the top of the load and preferably high enough in relation to the top of load 110 that the edges overlap the top corners underneath the displaced portion of waterproof top sheet 122, fold over the corners, and thus conform to load 110. The overlap amount may be minimal or it may be large, as much as three inches. While this overlap is not essential, it is preferred for enhanced moisture resistance.

During this process of lifting edges 140 of waterproof top sheet 122, the central area of waterproof top sheet 122 may be held in place by the use of a platen 132, mat, bean bag or other similar item placed upon the center of the waterproof top sheet and load. After the structure for lifting edges 140 of waterproof top sheet 122 is activated, the controller will initiate the wrapping of the sides of load 110 with waterproof packaging material 116 by providing relative rotation between dispenser 114 and load 110. Waterproof packaging material 116 may be fed through wrap dispenser 114 by the drive provided by the relative rotation between load 110 and dispenser 114 or may be assisted by a motor which drives the rollers of dispenser 114.

Figure 5:
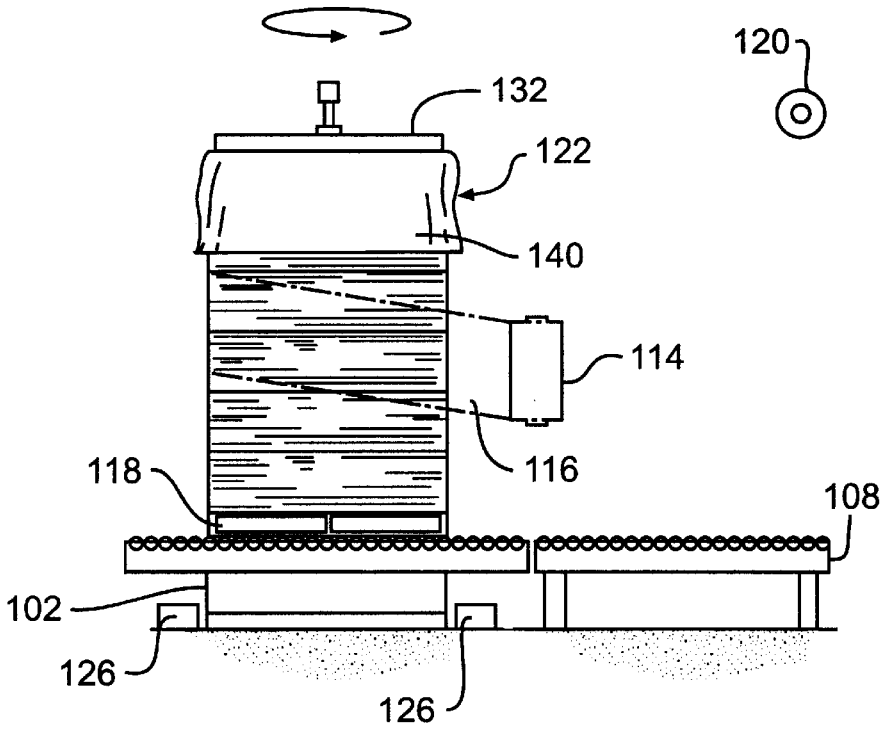

Once the sides of load 110 have been wrapped, edges 140 of waterproof top sheet 122 are released. This is accomplished when the controller shuts off fan 126. If it is desired to release edges 140 and also force down edges 140 of waterproof top sheet 122, an upper fan 204 may be provided above the load wrapping area and turned on as a lower fan 202 is shut off, as shown in FIG. 11. FIG. 5 shows a side view of load 110 after its sides have been wrapped with waterproof packaging material 116, and edges 140 of waterproof top sheet 122 have been released. After edges 140 of waterproof top sheet 122 are released, the controller will activate the structure for securing edges 140 of waterproof top sheet 122 around load 110. Edges 140 of waterproof top sheet 122 are then secured over the wrapped sides of load 110. The securing of top sheet edges 140 may be accomplished in a variety of manners. FIG. 6 shows edges 140 secured by a second layer of waterproof packaging material 116 wrapped around the sides of load 110. Alternatively, the edges may be banded around the load, an adhesive may be applied to secure the edges of the waterproof top sheet to the wrapped sides, or the edges of the waterproof top sheet may be secured by rope around the wrapped sides of the load. After edges 140 of waterproof top sheet 122 are secured, the structure for holding the center of waterproof top sheet 122 is removed from load 110, and the wrapped load begins to move off the turntable as a new load 110*a* receives a t waterproof op sheet 122*a* before it indexes into the wrapping area, as shown in FIGS. 7 and 8.

In the embodiment shown in FIG. 9, the method of wrapping load 110 is substantially the same as described for FIGS. 1–8, with the exception that a vacuum or reverse fan 128 is used to move edges 140 of waterproof top sheet 122 before wrapping of load 110 commences. When vacuum or reverse fan 128 is shut off, edges 140 of waterproof top sheet 122 are released. It is to be understood that the vacuum or reverse fan shown in FIG. 9 may be capable of also blowing air which would be used to force edges 140 over the side of load 110.

In the embodiment shown in FIG. 10, the method of wrapping load 110 is substantially the same as described for FIGS. 1–8, with the exception that structure for mechanically grasping edges 140 of waterproof top sheet 122 is used to move edges 140 before wrapping of load 110 commences. Mechanical grasping means 130 grasps edges 140 of waterproof top sheet 122 and moves them upward. Once the sides of the load have been wrapped, mechanical grasping means 130 releases edges 140. Mechanical grasping means 130 may comprise, for example, pinchers, clamps, or any other suitable device for holding and lifting edges of a top sheet.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the general inventive concept as defined by the appended claims and the equivalents.

What is claimed is:

1. A method of wrapping a top and sides of a load, comprising:

placing a waterproof top sheet having edges and a central area on top of a load such that the edges of the top sheet extend downwardly over the sides of the load;

lifting the edges of the waterproof top sheet away from the load;

dispensing waterproof packaging material from a packaging material dispenser and providing relative rotation between the load and the packaging material dispenser to wrap waterproof packaging material around the sides of the load in a wrapping area, covering the sides of the load with the waterproof packaging material and positioning a portion of the waterproof packaging material beneath the edges of the waterproof top sheet while the edges of the waterproof top sheet are lifted;

lowering the edges of the waterproof top sheet over the dispensed sheet of waterproof packaging material on the sides of the load;

securing the edges of the waterproof top sheet over the dispensed sheet of waterproof packaging material on the sides of the load.

2. The method of claim 1 wherein the lifting includes blowing the edges of the waterproof top sheet with air.

3. The method of claim 2 including using a fan to perform the blowing.

4. The method of claim 2 including using ducted air to perform the blowing.

5. The method of claim 2 including holding down the central area of the waterproof top sheet during the blowing.

6. The method of claim 2 wherein the lowering includes terminating the blowing of the edges of the waterproof top sheet with air.

7. The method of claim 1 wherein the lowering includes blowing the edges of the waterproof top sheet with air.

8. The method of claim 1 where the securing includes overwrapping the edges of the waterproof top sheet.

9. The method of claim 1 wherein the securing includes overwrapping the edges of the waterproof top sheet by dispensing waterproof packaging material from the packaging material dispenser and providing relative rotation between the load and the packaging material dispenser to overwrap waterproof packaging material around the edges of the waterproof top sheet in the wrapping area.

10. The method of claim 9 wherein the overwrapping of waterproof packaging material covers the sides of the load.

11. The method of claim 1 wherein the waterproof top sheet placing is performed outside the wrapping area and subsequently the load and waterproof top sheet are transported to the wrapping area for the lifting, dispensing, lowering and securing.

12. Apparatus for wrapping a top and sides of a load, comprising:

a packaging material dispenser for dispensing waterproof packaging material in a wrapping area;

a top sheet dispenser for placing a waterproof top sheet having edges on top of the load such that the edges of the top sheet extend downwardly over the sides of the load;

means for providing relative rotation between the load and the packaging material dispenser in the wrapping area to wrap waterproof packaging material around the sides of the load in the wrapping area;

means for lifting edges of a waterproof top sheet on the load in the wrapping area to permit waterproof packaging material to be wrapped around the sides of the load beneath the edges of the waterproof top sheet while the edges of the waterproof top sheet are lifted.

13. The apparatus of claim 12 wherein the top sheet dispenser is located outside the wrapping area.

14. The apparatus of claim 12 where the lifting means include a blower for blowing the edges of the waterproof top sheet away from the load.

15. The apparatus of claim 14 wherein the blower includes a fan.

16. The apparatus of claim 14 wherein the blower includes a duct.

17. The apparatus of claim 14 including means for holding down a central area of the waterproof top sheet while blowing the edges of the waterproof top sheet.

18. The apparatus of claim 12 including a controller for controlling the means for providing relative rotation and the means for lifting, for wrapping a layer of waterproof packaging material on the load beneath the waterproof top sheet while the edges of the waterproof top sheet are lifted, for covering the sides of the load with waterproof packaging material and positioning a portion of the waterproof packaging material beneath the edges of the waterproof top sheet, and for overwrapping the edges of the waterproof top sheet with waterproof packaging material while the edges of the waterproof top sheet are not lifted.

19. The apparatus of claim 18 wherein the top sheet dispenser is located outside the wrapping area and wherein the controller controls the top sheet dispenser to place the waterproof top sheet on top of the load.

20. The apparatus of claim 19 including a conveyer for conveying the load and waterproof top sheet from the top sheet dispenser to the wrapping area and wherein the controller controls the conveyer.

21. A method of wrapping a top and sides of a load, comprising:

placing a waterproof top sheet having edges and a central area on top of a load such that the edges of the top sheet extend over the sides of the load;

blowing the edges of the waterproof top sheet with air to lift the edges away from the load;

dispensing waterproof packaging material from a packaging material dispenser and providing relative rotation between the load and the packaging material dispenser to wrap waterproof packaging material around the sides of the load in a wrapping area while blowing the edges of the waterproof top sheet;

lowering the edges of the waterproof top sheet over the wrapped sides of the load; and securing the edges of the waterproof top sheet over the dispensed sheet of waterproof packaging material on the sides of the load.

22. The method of claim 21 including using a fan to perform the blowing.

23. The method of claim 21 including using ducted air to perform the blowing.

24. The method of claim 21 including holding down the central area of the waterproof top sheet during the blowing.

25. The method of claim 21 wherein the lowering includes terminating the blowing of the edges of the waterproof top sheet with air.

26. The method of claim 21 wherein the lowering includes blowing the edges of the waterproof top sheet with air.

27. The method of claim 21 where the securing includes overwrapping the edges of the waterproof top sheet.

28. Apparatus for wrapping a top and sides of a load, comprising:

a packaging material dispenser for dispensing waterproof packaging material in a wrapping area;

a topsheet dispenser for placing a waterproof top sheet having edges and a central area on top of a load such that the edges of the top sheet extend over the sides of the load;

means for providing relative rotation between the load and the packaging material dispenser in the wrapping area to wrap waterproof packaging material around the sides of the load in the wrapping area;

a blower for blowing the edges of the waterproof top sheet away from the load while in the wrapping area to permit waterproof packaging material to be wrapped around the sides of the load beneath the edges of the waterproof top sheet while the edges of the waterproof top sheet are lifted.

29. The apparatus of claim 28 wherein the top sheet dispenser is located outside the wrapping area.

30. The apparatus of claim 28 wherein the blower includes a fan.

31. The apparatus of claim 28 wherein the blower includes a duct.

32. The apparatus of claim 28 including means for holding down a central area of the waterproof top sheet while blowing the edges of the waterproof top sheet.

33. The apparatus of claim 28 including a controller for controlling the means for providing relative rotation and the blower, for wrapping a layer of waterproof packaging material on the load beneath the waterproof top sheet while the edges of the waterproof top sheet are lifted, for covering the sides of the load with waterproof packaging material and positioning a portion of the waterproof packaging material beneath the edges of the waterproof top sheet, and for overwrapping the edges of the waterproof top sheet with waterproof packaging material while the edges of the waterproof top sheet are not lifted.

* * * * *